US005664260A

United States Patent [19]

Weiser

[11] Patent Number: 5,664,260

[45] Date of Patent: Sep. 9, 1997

[54] GLOVE AND METHOD OF MAKING THE SAME

[76] Inventor: Charles W. Weiser, 1310 Providence Rd., NE., Massillon, Ohio 44646

[21] Appl. No.: 730,078

[22] Filed: Oct. 15, 1996

[51] Int. Cl.[6] ..... A41D 19/00

[52] U.S. Cl. ..... 2/159; 2/161.3; 2/169

[58] Field of Search ..... 2/158, 159, 160, 2/161.1, 161.2, 161.3, 161.4, 161.5, 161.6, 161.7, 161.8, 161.9, 162, 163, 164, 166, 167, 168, 169, 170

[56] References Cited

U.S. PATENT DOCUMENTS

| | | | |
|---|---|---|---|
| 2,447,951 | 8/1948 | Lindfelt | 2/167 |
| 4,561,122 | 12/1985 | Stanley et al. | 2/161.2 X |
| 5,146,627 | 9/1992 | Weiser | 2/169 X |

FOREIGN PATENT DOCUMENTS

| | | | |
|---|---|---|---|
| 2200275 | 8/1988 | United Kingdom | 2/159 |

*Primary Examiner*—C. D. Crowder
*Assistant Examiner*—Shirra L. Jenkins
*Attorney, Agent, or Firm*—Sand & Sebolt

[57] ABSTRACT

An improved glove and method of making same whereby the palm portion has only one continuous seam reconnecting the palmar area after its reduction in dimensions to eliminate wrinkling or bunching thereat as well as connecting the unconnected side between the front and back faces. A close smoother fit of the hand at the palm area is obtained in the crease or fold line areas of the wearer's palm where an overlapped seam is created as manufactured or in modified gloves for improved gripping. In addition, one continuous seam makes assembly of the glove both easier and faster.

16 Claims, 7 Drawing Sheets

GLOVE AND METHOD OF MAKING THE SAME

BACKGROUND OF THE INVENTION

1. Technical Field

The present invention relates generally to gloves. More particularly, to an improved glove having a reduced palmar area and a method of making the same. Specifically, the invention relates to gloves which reduce wrinkling or bunching adjacent the user's palm; thereby supplying the user with a more positive and accurate grip.

2. Background Information

It has been found through a detailed investigation of gaming and work gloves that one of the major reasons conventional gloves do not and cannot provide an improved grip is that such gloves closely follow the contour of the normal hand facing surfaces when the hand is fully extended which is contrary to the hand position when a user's hand is grasping an item, such as an axe, racket or club such as a golf club. Both friction-type and non-friction-type gripping strips by themselves or in combination with exterior pads have been utilized on prior art gloves on their exterior facing surfaces to prevent slippage of a gripped item within the user's hand; however, such strips do not improve the actual grip about the item and instead merely provide cushion to the hand to prevent blisters and callouses as well as undue muscle fatigue.

In response, it is a noticeable trend of many user's such as golfers and drivers to wear very tight gloves in an attempt to enhance "feel" by being able to feel the glove on the hand. However, regardless of the tightness of the glove, it is readily apparent that certain voids and other open areas are present between the surface of the hand and the surface of the gripped item when the hand is holding an item, such as a club or steering wheel using any conventional single-layer glove as are well known in the art, one of which is from the front and the back as shown in FIGS. 1 and 2. Such voids and open areas are created as a result of the contrasting soft fleshy portions of the fingers and especially the palm of the individual's hand when the hand grips the contoured surface of the item to be gripped.

Specifically, it has been found that the actual gripping force is deleteriously affected as the closed hand within the glove produces these voids or open areas in the fold or crease areas of the palm which are contrary to obtaining improved gripping with more uniform compression force of the hand on the item. The voids and open areas severely limit the firm contact area between the hand and the item. The palmar area of the glove as shown in FIG. 1 normally wrinkles at the crease areas of the palm just below the finger stalls of the hand thereby decreasing the hand holding power.

During many activities, such as splitting wood or swinging a golf club, it is essential that the user be able to recreate and repetitiously perform the proper gripping action. In response, the improved golf glove with reduced palmar area was developed as described in U.S. Pat. No. 5,146,627 issued to Charles Weiser on Sep. 15, 1992. This improved glove takes into account the realization that the palm of the hand in its natural position is slightly concave providing a concavity which deepens as the hand flexes in grasping.

This realization is based upon the concept that when the smaller fingers at one side of the palmar area, on the opposite side of the concavity from the thumb, feel the greatest pressure on an item lying across the palm, the diagonal relationship of the item to the palm allows the minor fingers of the hand starting with the little, ring and middle fingers, in that order, to close around and surround the item. If the hand is deformed from the preferred grip when grasping the item, as occurs when a conventional glove bunches up, position of the item may be substantially altered due to slippage. Additionally, the glove of U.S. Pat. No. 5,146,627 exploits the fact that the distance between finger stalls and the first crease line of the user's palm is identical for all users regardless of the user's size or physical stature. This fact assures that the appropriate amount of material is removed from the palmar area thereby assuring that the palmar area of the glove contains little extra fabric which will bunch or gather when the user's hand is moved to a grasping position.

The improved glove with a reduced surface area in the palmar region as described in the Weiser patent has a contour complemental to the major flexed portion of the palm when closed about an item to be grasped. This eliminates problems of maintaining the proper grip. The invention of the '627 patent solves the problem of proper gripping by reducing the palmar area.

However, although this Weiser glove solves the gripping problem, it has more recently become a manufacturing consideration that only one seam is most desirable for ease and speed of manufacturing rather than the conventional two seams found in all conventional prior art gloves including the Weiser glove. Specifically, some conventional golf gloves include one body seam found along each side of the finished glove where the front and back faces of leather or other material are affixed together to form the finished glove as assembled from the two initially planar pieces of leather or other material. In addition, most if not all conventional golf gloves also include an additional seam to affix the thumb area to the body area, as well as additional seams associated with affixation of each of the fingers. Therefore, conventional golf gloves include a body seam down each side of the glove, and in some cases multiple thumb and fingers seams also, prior to any consideration of the void and open area problems in the palmar area as described above. One such conventional glove without palmar reduction is shown in FIGS. 1 and 2 with one body seam down each side to the wrist, as well as one thumb seam affixing the thumb to the body. Additionally, the glove described in the '627 patent has been inspected by the U.S.G.A. which has determined that the glove included in the '627 patent does not violate the rules of golf therefor assuring that the glove of the '627 reference is available for use on tour.

The Weiser golf glove accounts for palmar reduction but it includes multiple body seams, specifically one seam across the palmar area where the excess material was removed, and a seam as is found in all conventional gloves down each side of the glove for holding the front and back faces together. However, today's golf gloves are now manufactured from one piece of material rather than two using only one seam on one side of the glove rather than one seam on each side of the glove for ease and speed of manufacturing. For this reason, a different approach to reducing the palmar area is required to eliminate seams on both sides of the glove. Additionally, while the glove of the '627 patent is adequate for the purpose intended in that it reduces the glove material between the finger stalls and the first crease of the user's palm while providing a seam to position between the fleshy portions of the user's palm when the hand is moved to a closed position, it does little to remove the excess material between the user's index finger and thumb.

As such, the need exists for a glove which may be manufactured of a single seam along the side portion thereof, while simultaneously providing a glove which provides a reduced palmar area and which increases the glove tension in the area intermediate the user's index finger and thumb so as to further increase gripping action associated with the user's curled hand.

SUMMARY OF THE INVENTION

Accordingly, it is an object of present invention to provide a glove having a reduced palmar area to enhance the pressure being felt between the palm and item to be grasped to providing greater and more uniform compressive force on the item over a broader area.

Another object of the invention is to provide a glove having a reduced palmar area while providing a seam which may be gripped between the fleshy portions of the user's hand to pull the glove intermediate the fleshy portions of the user's hand when the user's hand is moved to a curled position.

A further object of the invention is to provide a glove having a continuous seam from the palm region intermediate the thumb and index finger portions of the glove and which extends down to the wrist area of the glove.

Another object of the invention is to provide a glove having a reduced palmar area to reduce the gapping or bunching of material within the user's palm while simultaneously increasing the tension in the position at a location intermediate the user's thumb and index finger by pulling the material closer to the user's hand intermediate the user's thumb and index finger.

Yet another object is to provide such a glove which is of simple construction, which achieves the stated objectives in a simple, effective and inexpensive manner, and which solves problems and satisfies needs existing in the art.

These and other advantages and objectives of the invention are obtained by the glove for enhanced feel and gripping action, the general nature of which may be stated as including a substantially single layer pliable material that is continuously seamed comprising a palmar surface of a reduced area; a thumb area, an index finger area, a side area, a wrist area, and a continuous seam extending across the palmar surface of a reduced palmar area to a position intermediate said thumb area and said index finger area and continuously therefrom along said side to said wrist area.

These and other advantages and objectives of the invention are also obtained by the improved method for manufacturing a glove comprising the steps of trimming the area between the thumb and index finger in said glove to the wrist area so the seam formed in the forming and extending steps is a smooth and continuous seam; and reducing the area extending between the thumb and index finger to enhance feel and increase gripping action.

BRIEF DESCRIPTION OF THE DRAWINGS

A preferred embodiment of the invention, illustrative of the best mode in which applicant has contemplated applying the principles, is set forth in the following description and is shown in the drawings and is particularly and distinctly pointed out and set forth in the appended claims.

Similar numerals refer to similar parts and elements throughout the drawings.

DESCRIPTION OF THE PREFERRED EMBODIMENT

Figure 1:
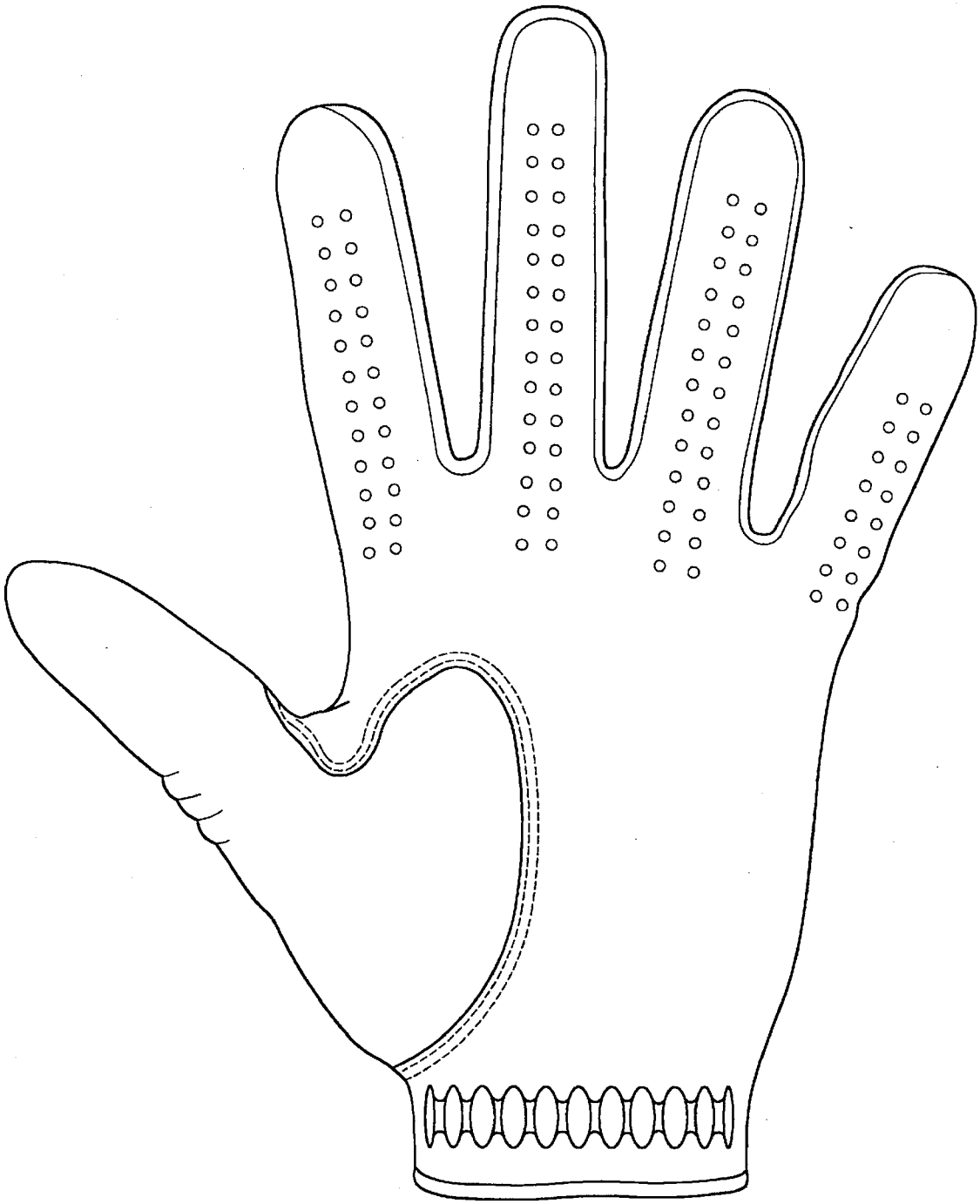
FIG-1 PRIOR ART
FIG. 1 is a front view of a conventional full-hand glove.
Figure 2:
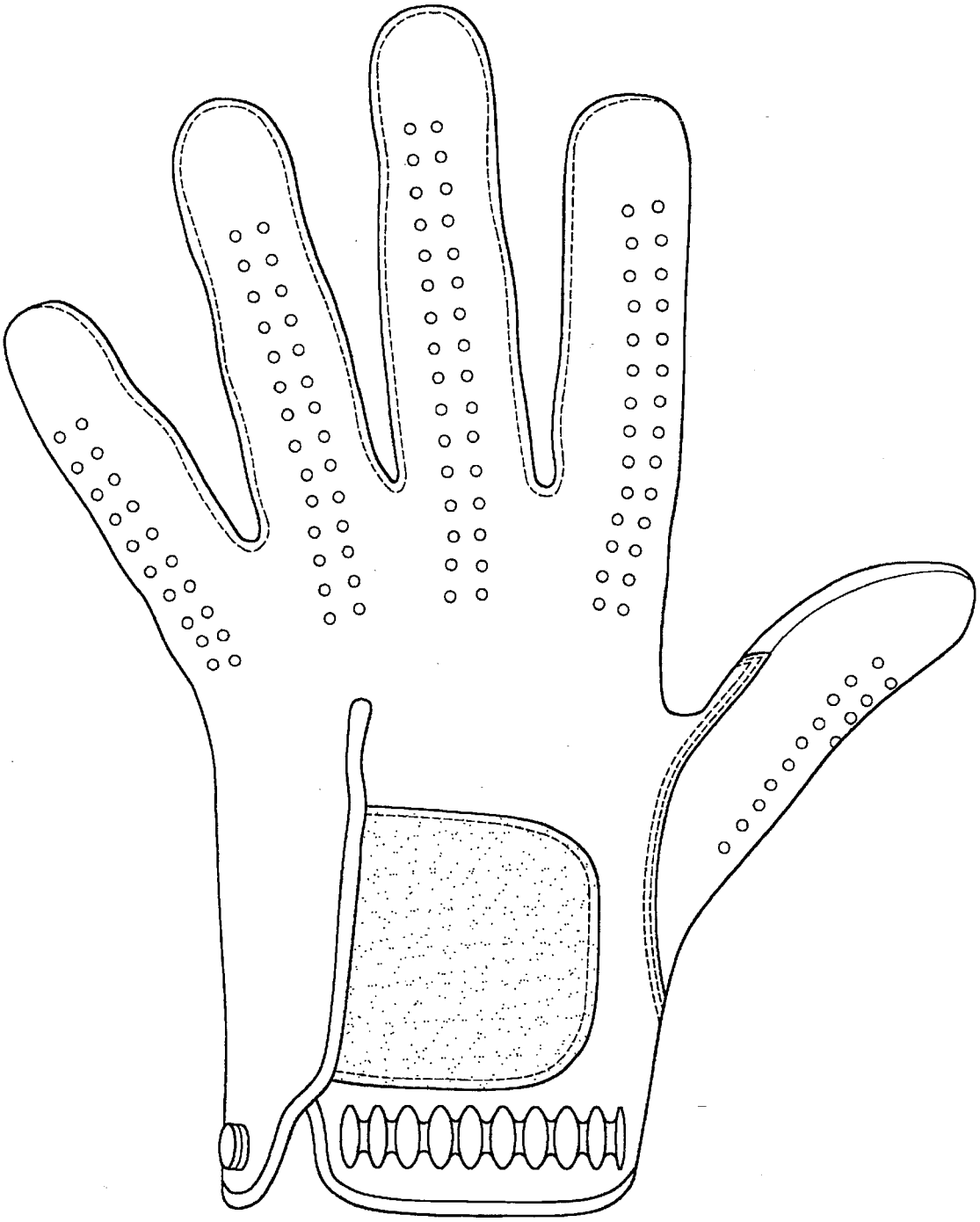
FIG-2 PRIOR ART
FIG. 2 is a back view of the prior art glove shown in FIG. 1.
Figure 3:
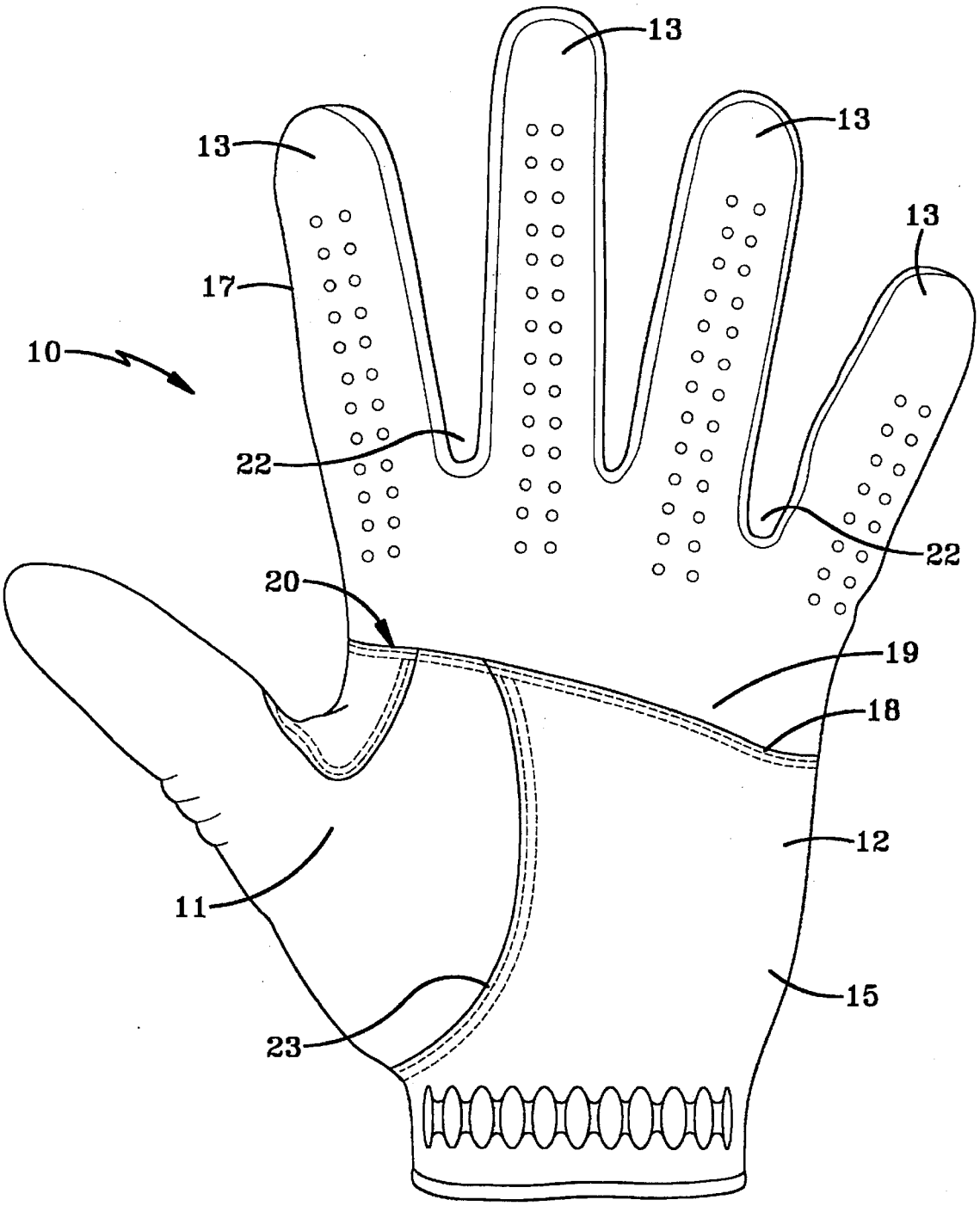
FIG. 3 is a front view of the glove of the present invention including a reduced palmar area with one continuous seam thereacross continuing between the index finger and thumb to the wrist area.

A preferred embodiment of the present invention is shown in FIG. 3 which is a front view of the left-hand glove 10 of the full-glove type. The glove normally is formed of leather, synthetic leather-like material, or synthetic material combined with leather, to tightly encompass and follow essentially the full contour of the left hand. Glove 10 preferably is formed as a full-hand glove encompassing the complete hand rather than a half-glove which has the finger areas cut off at their mid-point. The invention will be described with respect to the full-hand glove type although the invention is equally applicable to other glove types such as the half-glove type. Additionally, the invention is equally applicable to both right and left hand gloves.

Glove 10 is normally made as a single-layer of material with a thumb-piece portion 11 sewn to the palm portion 12 to permit free movement of the thumb and provide a tight fit. In addition, the finger elements 13 are normally sewn to the palm portion 12, the facing and rear portions of the finger elements normally having small apertures therein for proper ventilation.

During glove manufacture, a pattern is used to cut the desired glove shape from a bolt or other piece of the above described materials from which the glove is to be made. The cut piece includes both the front face 15 and the back face 16 of the glove 10 connected by an index finger side 17 which eliminates the need to sew the front and back face together along the index finger side.

After the cut piece has been cut to define one piece including the front face, index finger side, and the back face, the palmar surface area 19 of the glove must be reduced in dimensions at a central region, the front and back faces must be trimmed so that side seam 14 and a palmar seam 18 are aligned for sewing in one continuous manner resulting in one continuous seam 20, and the side of the glove is optionally reduced in dimension to eliminate the need for the elastic that may be inserted into the back of the glove. These three steps may occur in any order so long as all three occur prior to the assembly of the glove which typically occurs by sewing the seam together.

The palmar surface area 19 of glove 10 must be reduced in dimensions at a central region as set forth in the '627 patent. Specifically, an upper and lower curved line in the palm area of the material are severed and overlapped upwardly and interiorly to the upper curved line. By cutting out this portion, the glove will have a shortened palm which closely matches the full concavity of the palm when the hand is curled. A taut fit is thereby obtained which virtually eliminates wrinkling at the creases of the palm when gripping an item, such as a golf club. More uniform gripping pressure over a greater surface area is then obtained. Thus, the gripping action is increased both qualitatively and quantitatively, being less dependent upon the hand strength.

Specifically, the area to be removed is correctly determined by marking the area which occurs directly over the voids and wrinkles in the palm area of a cupped hand to determine the amount of excess material to be removed from the palmar area.

In the manufacture of the glove, the thumb piece 11 joined to the palmar area should be cut more flat in the palmar area rather than the standard V-shape. Also, the finger stalls 13 and thumb piece 11 should be extended by a minimum of about ⅛ inch to ensure a more comfortable fit in those areas in view of the shortened palm. In addition, the wrist area material should also be extended a short dimension, preferably to a minimum of about ½ the maximum width of the "oval" in the palmar area.

Figure 4:
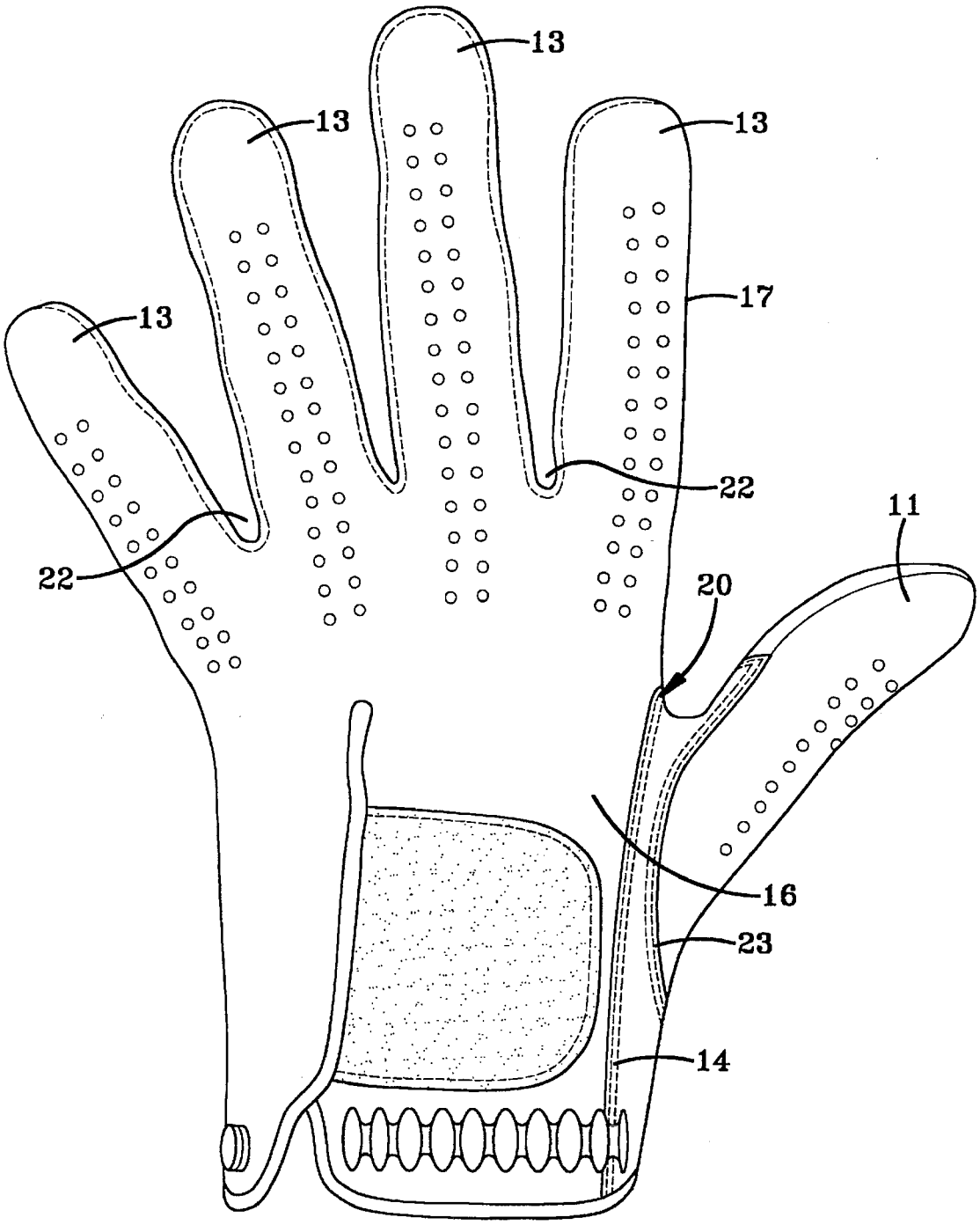
FIG. 4 is a back view of the glove of the present invention as shown in FIG. 3.
Figure 5:
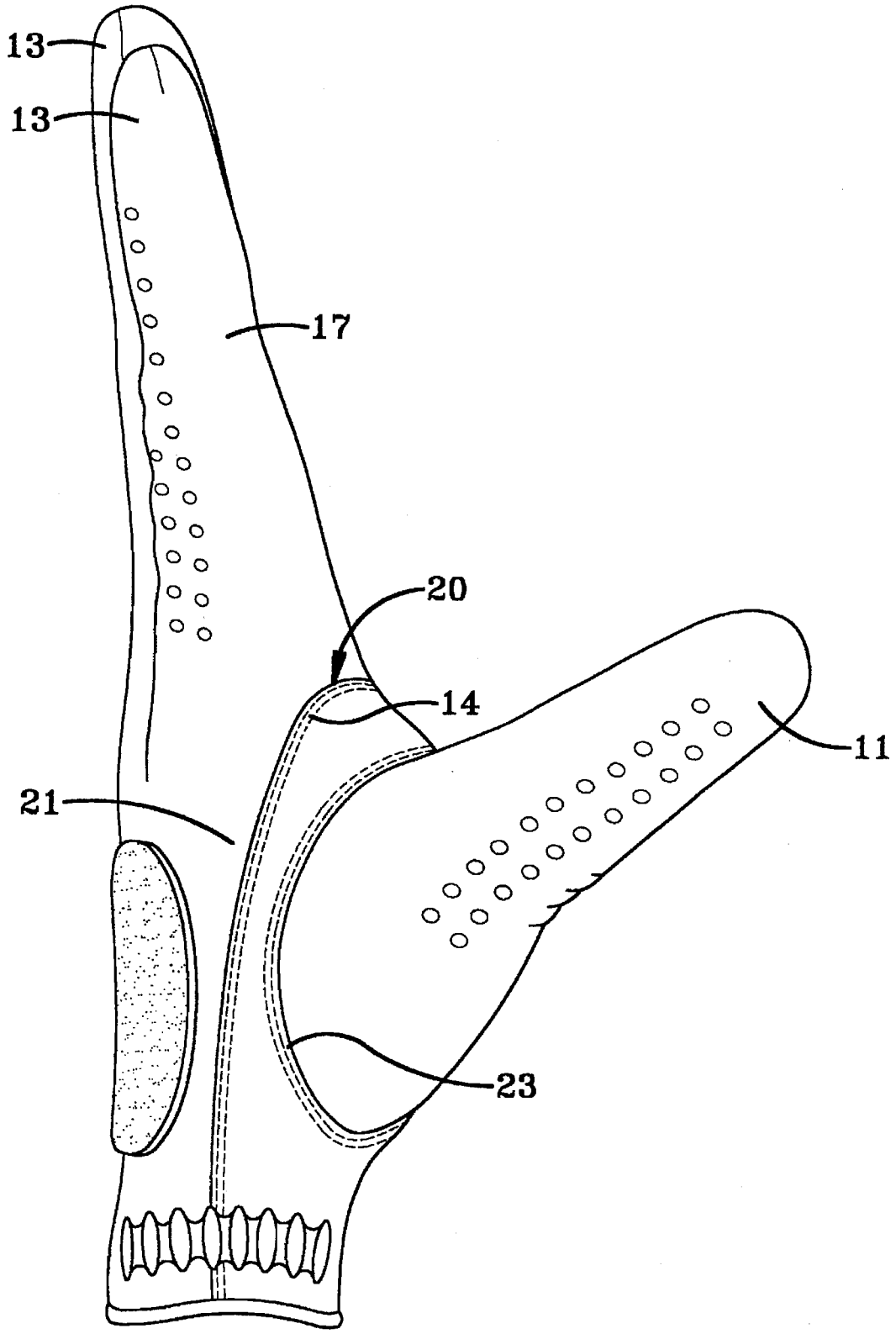
FIG. 5 is a thumb side view of the glove of the present invention.
Figure 6:
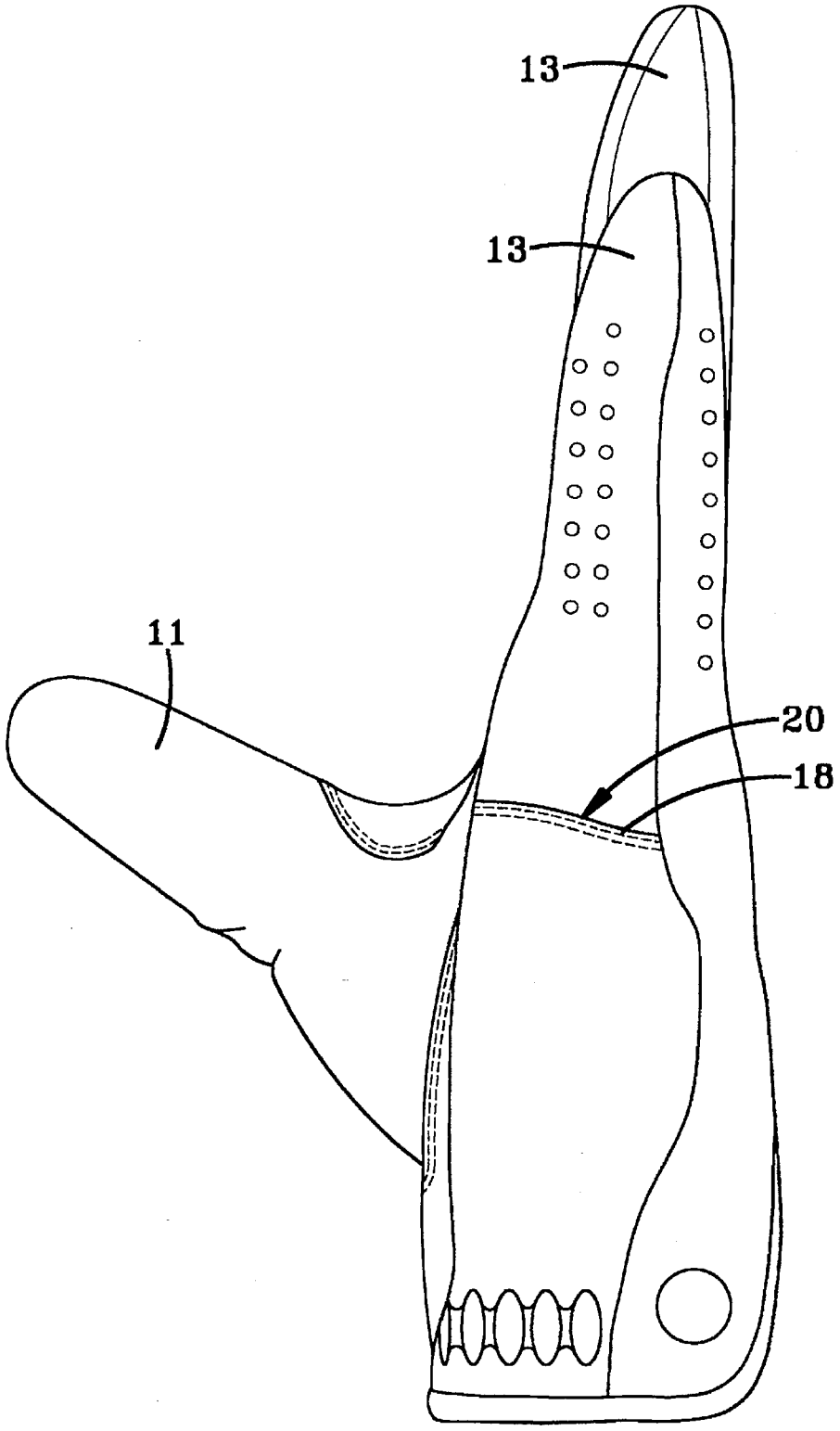
FIG. 6 is an opposite side view of the glove of the present invention as shown in FIG. 5.
Figure 7:
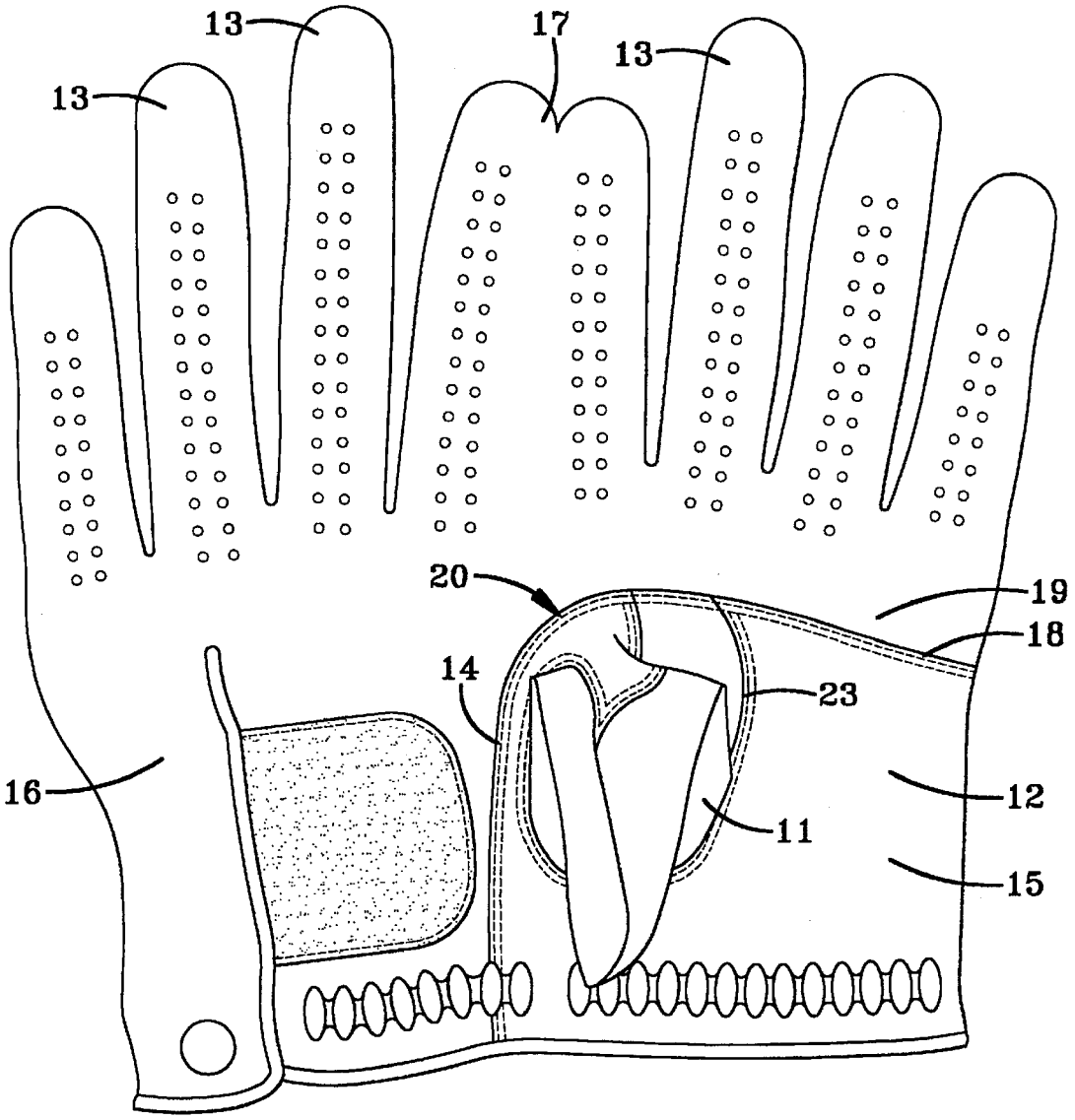
FIG. 7 is a front view of the glove of FIG. 3 prior to final seaming.

The method for determining the precise material to be removed from the glove palmar area consists of a closing of the hand and fingers into a more cupping position from the straight-out or fully-extended finger/hand position. The cupping of the hand and fingers will result in a more natural hand-carrying position and will determine the amount of excess material in the palmar area to be removed. The seam in the glove runs through the palmar area over the void in the hand (i.e. over the fold or crease lines) which connects the two sides of the cut in the palmer area. The seam at such position does not interfere with proper gripping action and actually strengthens the glove at such area due to the overlap. Additionally, side seam 14 extends from the end of palmar seam 18, intermediate finger 13 and thumb and along the rear of glove 10 to the wrist area as shown specifically in FIG. 4. Just as the material in the palmar area is reduced as described hereinabove, the material existing intermediate the pointer finger and thumb of glove 10 is also reduced so as to urge the material to a position directly adjacent the user's skin intermediate the thumb and index finger. Additionally, the material extending along the rear of the glove is foreshortened so as to increase the pressure existing along the rear of the glove thereby substantially eliminating the need for elastic inserts.

After the palmar area has been reduced as described above, the front face and the back face are sewn together at side seam 14 along the remaining unconnected side, that is, along the index finger/thumb side 21 which is adjacent to the thumb seam 23. At approximately the same time, the overlapped area is also sewn into palmar seam 18 at the upper line. The index finger/thumb side seam 14 and the overlapping palmar seam 18 are affixed together using any known adhering method such as by nylon thread, or alternatively an adhesive material may also be employed in permanently joining the overlapped area.

Specifically, the preferred embodiment of the present invention contemplates only one continuous seam 20 for sewing both the remaining unconnected side together and the palm surface area 19 back together along the cut after the removal of the reduced area resulting in the overlapping palm surface. The one seam 20 of the preferred embodiment is one continuous seam extending continuously and smoothly across the remaining unconnected side 21 as side seam 14 and the palm surface area 19 as palmar seam 18, the seam being continuous and smooth because the below described preferential method of aligning the side seam 14 and the palmar seam 18 during cutting of said seams.

The method of manufacturing the preferred embodiment of glove 10 is one of determining and marking the location of the area to be reduced or eliminated from the palm area, and aligning these markings with side seam 14. Seams 14 and 18 thus define a continuous and smooth seam 20. This method results in a close smoother fit of the glove in the palmar area in the crease or fold line area of the wearer's palm where the overlapped seam or sewn seam is created after elimination of some of the material therefrom. Seam 18 continues in the area of the side of the hand from the index finger area to the wrist area reducing the glove dimension across the back of the hand resulting in a manufactured or a modified glove for improved gripping.

The basis for the reduction of the excess material that exists in the palmar surface area 19 is based on the fact that the distance from the finger stalls 22 to the major void or crease or fold line in the area of the wearer's hand is constant, in the same length dimension, for all adult's hands, both for men and women, large hands or small hands. Knowing that the distance in length remains the same in the area between the finger stalls and the fold line in the palmar area enables a material reduction to be made and the manufacture of a seam in the palmar area that will always fit into the void or fold line of the hand.

After marking exactly the crease or void in the fold line, the distance to move back toward the wrist is determined. The distance to mark the line between the index finger and the glove wrist from the palmar area is determined in alignment with the line drawn along which the palm cut is to be made. The cut is then made over the palmar region and the trimming from the index finger to the glove wrist. The severed glove is moved forward and either overlapped over the crease line and sewn, or brought together and sewn on the inside of the glove. In either case, the seam is over the fold line and continues up the side of the glove from between the thumb and index finger to the wrist area.

The improved structure of the subject glove addresses the need to manufacture the glove using only one seam to assemble the palm portion while also addressing the problem of bunching and gathering of the glove material in the palmar area. Such problem occurs when the hand closes around the club grip which increases the amount of material in the fold lines of the palm. The improved structure is applicable to all golf glove sizes; small, medium, large, extra-large, etc.

The improved structure of the subject glove also operates to reduce the material intermediate the user's thumb and index finger while simultaneously increasing the pressure on the user's hand at this location for increased gripping action. Additionally, it is possible to increase the material in the longitudinal direction of the glove in order to assure that the wrist portion of the glove remains substantially parallel when material is removed from the palm area.

Increased gripping action and stability are attainable without exerting substantially increased effort or compressive pressure in the area of the hand. Increased gripping ability increases the hand-to-club relationship and permits more ready reproducibility of the preferred grip and increased "feel" which thereby aids in reducing the torque and slippage between the gloved hand and the item to be grasped.

The reduction in the palmar area of the subject glove may also be used in all types of gloves to grasp the handle of other sports devices such as a tennis racket, baseball bat or softball bat in an improved manner. The lesser palm area provides more firm gripping with increased stability and lesser slippage between the hand and handle prior to and during impact with the ball.

Accordingly, the improved glove and method of making are simplified, providing an effective, safe, inexpensive, and efficient athletic glove and method of grasping which achieves all of the enumerated objectives, provides for eliminating difficulties encountered with prior devices, and solves problems and obtains new results in the art.

In the foregoing description, certain terms have been used for brevity, clearness and understanding; but no unnecessary limitations are to be implied therefrom beyond the requirements of the prior art, because such terms are used for descriptive purposes and are intended to be broadly construed. Moreover, the description and illustration of the invention is by way of example, and the scope of the invention is not limited to the exact details shown or described.

Having now described the features, discoveries and principles of the invention, the manner in which the improved golf glove and method of making is practices in its several forms, the characteristics of construction, and the advantageous, new and useful results obtained; the new and useful structures, devices, elements, arrangements, parts and combinations, are set forth in the appended claims.

I claim:

1. An improved glove for enhancing feel and gripping action of a user's hand on an item to be grasped comprising:

a substantially single layer pliable material that is continuously seamed comprising a palmar surface of a reduced area, a thumb area, an index finger area, a side area and a wrist area; and a continuous seam extending across the palmar surface of a reduced palmar area to a position intermediate said thumb area and said index finger area and continuously therefrom along said side area to said wrist area.

2. The improved glove in accordance with claim 1 wherein said reduced area of the palmar surface resulting from seaming of a cut adjacent a fold line across the palmar facing surface.

3. The improved glove in accordance with claim 1 wherein said golf glove comprises a palm portion, a thumb portion, and a plurality of finger portions.

4. The improved glove in accordance with claim 3 wherein said palm portion includes a front face, a back face, and a index finger side all integrally connected.

5. The improved glove in accordance with claim 4 wherein the continuous seam further includes a palmar seam sewing the palmar surface back together after its area was reduced.

6. The improved glove in accordance with claim 4 wherein index finger side is of a reduced area to eliminate the need for elastic on the glove back.

7. The improved glove in accordance with claim 6 wherein the single layer pliable material extending intermediate the index finger area and thumb area is reduced.

8. A method of improving a conventional glove to enhance feel and gripping action of the hand on the golf club while also providing a design capable of easier and improved manufacture, comprising the steps of:

severing an area of a palmar facing surface on a glove in a curvilinear pattern substantially parallel to a wearer's palmar fold lines;

overlapping said severed area of said palmar surface of said glove in a long flat configuration;

forming a seam with an adjacent portion of said palmar facing surface to reduce the palmar facing surface area adjacent the said palmar fold lines so that on closing flexure of the wearer's hand a taut non-wrinkling fit is obtained; and extending said formed seam beyond the palmar facing surface area from between a thumb and index finger in said glove along the side of the glove to a wrist area.

9. The method of improving a conventional glove in accordance with claim 8, wherein the step of severing further comprises:

trimming the area between the thumb and index finger in said glove to the wrist area so the seam formed in the forming and extending steps is a smooth and continuous seam; and reducing the area extending between the thumb and index finger to enhance feel and increase gripping action.

10. The method of improving a conventional glove in accordance with claim 9, wherein the step of trimming further comprises:

trimming the area between the thumb and index finger in said glove to the wrist area to eliminate the need for elastic thereat.

11. The method of improving a conventional glove in accordance with claim 8 further comprising the step of:

prior to any severing step, marking the fold line in the palmar area of the glove to reduce the palmar surface area.

12. The method of improving a conventional glove in accordance with claim 8, further comprising the steps of:

prior to any severing step, marking the fold line in the palmar area of the glove to reduce the palmar surface area, and extending the marking of the fold line to smoothly and continuously curve around between the thumb and index finger of the glove to the wrist area.

13. The method of improving a conventional glove in accordance with claim 8, further comprising the steps of:

prior to any severing step, marking the fold line in the palmar area of the glove to reduce the palmar surface area, and extending the marking of the fold line to smoothly and continuously curve around between the thumb and index finger of the glove to the wrist area, and marking another line adjacent to the fold line in the palmar area whereby the severing occurs along said another line.

14. A method of improving a conventional glove to enhance feel and gripping action of the hand during an athletic contest comprising the steps of:

marking a pattern along a fold line in a glove across the palmar facing surface area on the glove;

extending the mark from the fold line in a curvilinear manner from between a thumb and an index finger area to a wrist area; and forming one continuous seam along the entire mark across the palmar facing surface and from between the thumb and index finger area to the wrist area.

15. The method of improving a conventional glove in accordance with claim 14 wherein the forming step further comprises the steps of:

cutting adjacent the fold line in the glove across the palmar facing surface; and trimming along the mark from the fold line between the thumb and index finger area to the wrist area.

16. The method of improving a conventional glove in accordance with claim 15 wherein the forming step further comprises the step of:

sewing the continuous seam along the cut fold line and the trimmed mark.

* * * * *